US007942797B1

(12) United States Patent
Canton et al.

(10) Patent No.: US 7,942,797 B1
(45) Date of Patent: May 17, 2011

(54) BALANCE BOARD FOR PIPE ROLLER

(76) Inventors: Chris Canton, Spring Valley, CA (US); John P. Canton, Spring Valley, CA (US)

( * ) Notice: Subject to any disclaimer, the term of this patent is extended or adjusted under 35 U.S.C. 154(b) by 0 days.

(21) Appl. No.: 12/633,735

(22) Filed: Dec. 8, 2009

(51) Int. Cl.
*A63B 22/14* (2006.01)

(52) U.S. Cl. ..... 482/146

(58) Field of Classification Search ..... 482/14–142, 482/146, 34, 148; 280/841; D21/760, 769; 441/74
See application file for complete search history.

(56) References Cited

U.S. PATENT DOCUMENTS 3,862,768 A * 1/1975 England ..... 280/205
3,895,794 A * 7/1975 England ..... 482/146
4,826,159 A * 5/1989 Hersey ..... 482/146
5,152,691 A * 10/1992 Moscarello ..... 434/247
D376,629 S * 12/1996 Mounts et al. ..... D21/412
5,643,164 A * 7/1997 Teff ..... 482/146
7,108,646 B1 * 9/2006 Quick ..... 482/148
7,695,407 B2 * 4/2010 Miller et al. ..... 482/51

* cited by examiner

*Primary Examiner* — Lori Baker
(74) *Attorney, Agent, or Firm* — Mintz Levin, P.C.; James Cleary, Esq

(57) ABSTRACT

A balance board includes an elongated, generally rigid board having a top surface, a bottom surface, and upwardly-angled distal ends and upwardly-angled side edges. The bottom surface of the board has a center plane that extends longitudinally between areas of the bottom surface proximate the upwardly-angled distal ends. The width of the center plane is defined by the upwardly-angled side edges. The bottom surface of the board is at least partially coated with a frictional material. A balance board system includes a cylindrical roller, preferably having a uniform cross-sectional size and shape along its length. The roller is formed of a smooth, rigid material. The system allows extreme tricks and moves by a rider of the board on the roller.

15 Claims, 8 Drawing Sheets

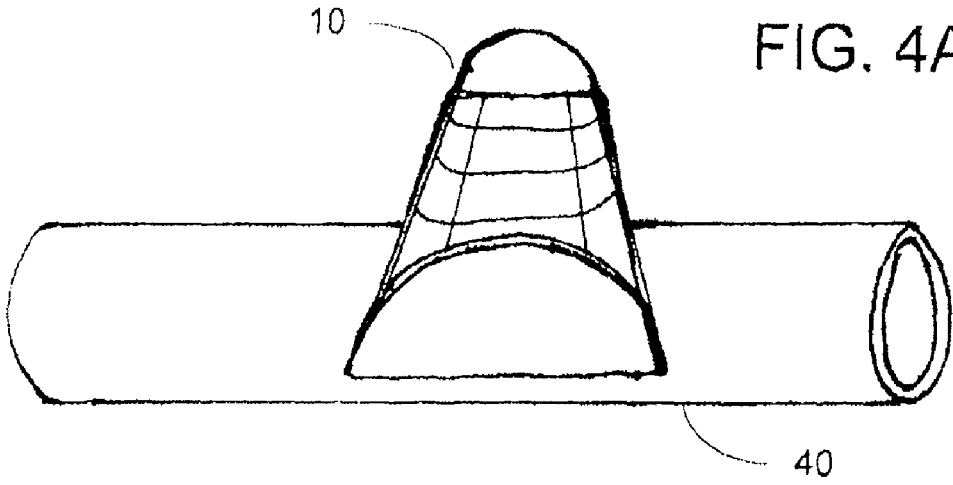
FIG. 4A
FIG. 4B
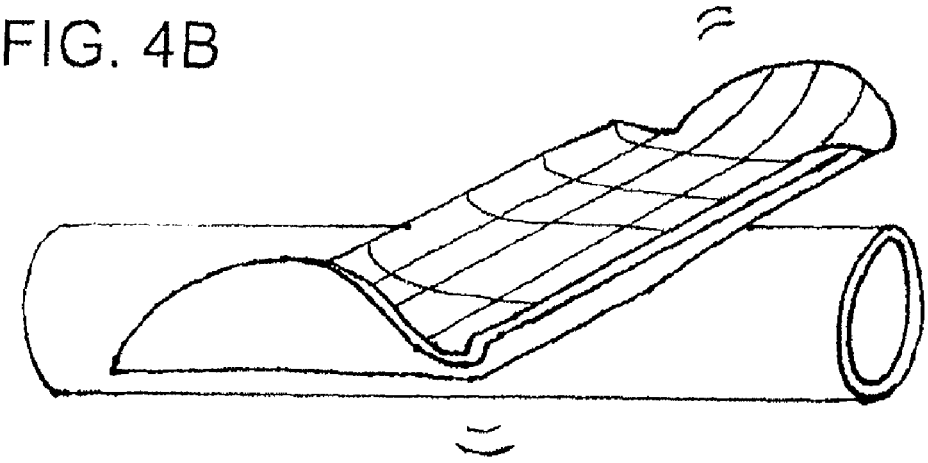
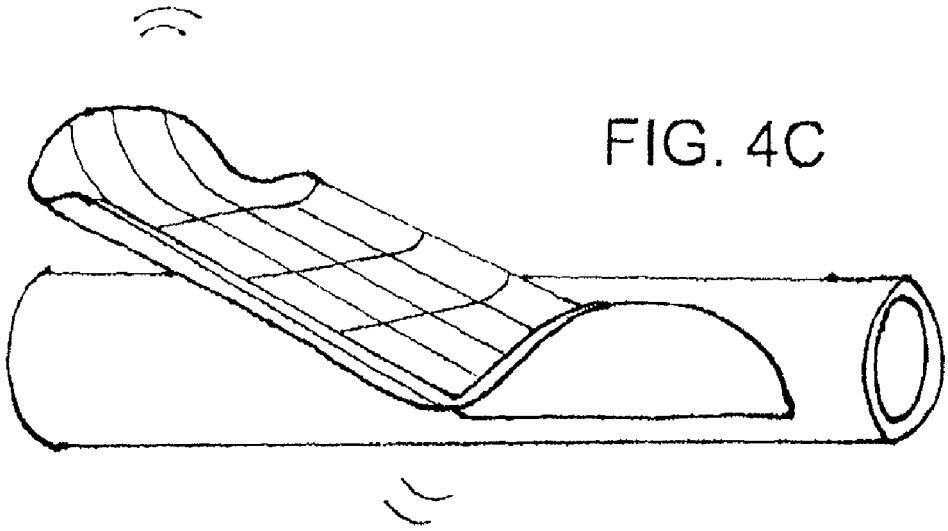
FIG. 4C

FIG. 7A
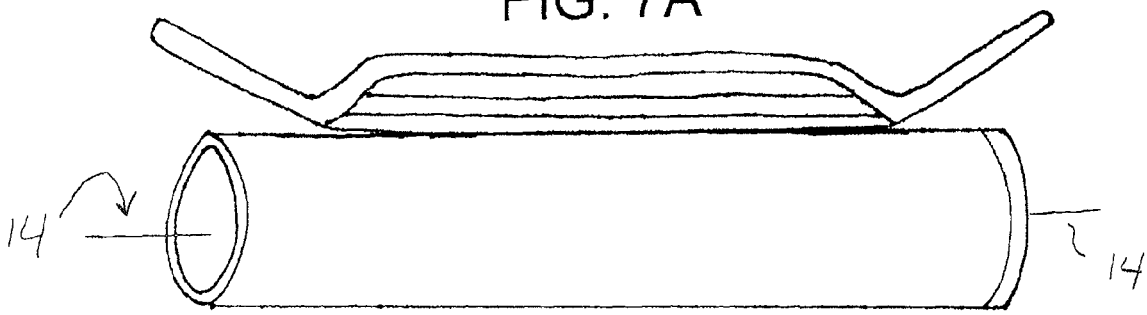
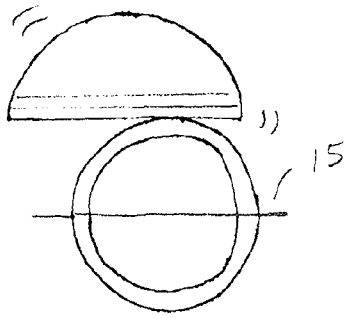
FIG. 7B
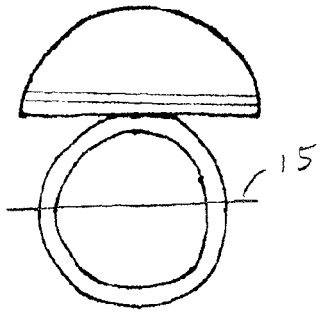
FIG. 7C
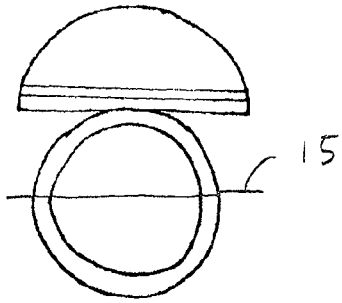
FIG. 7D

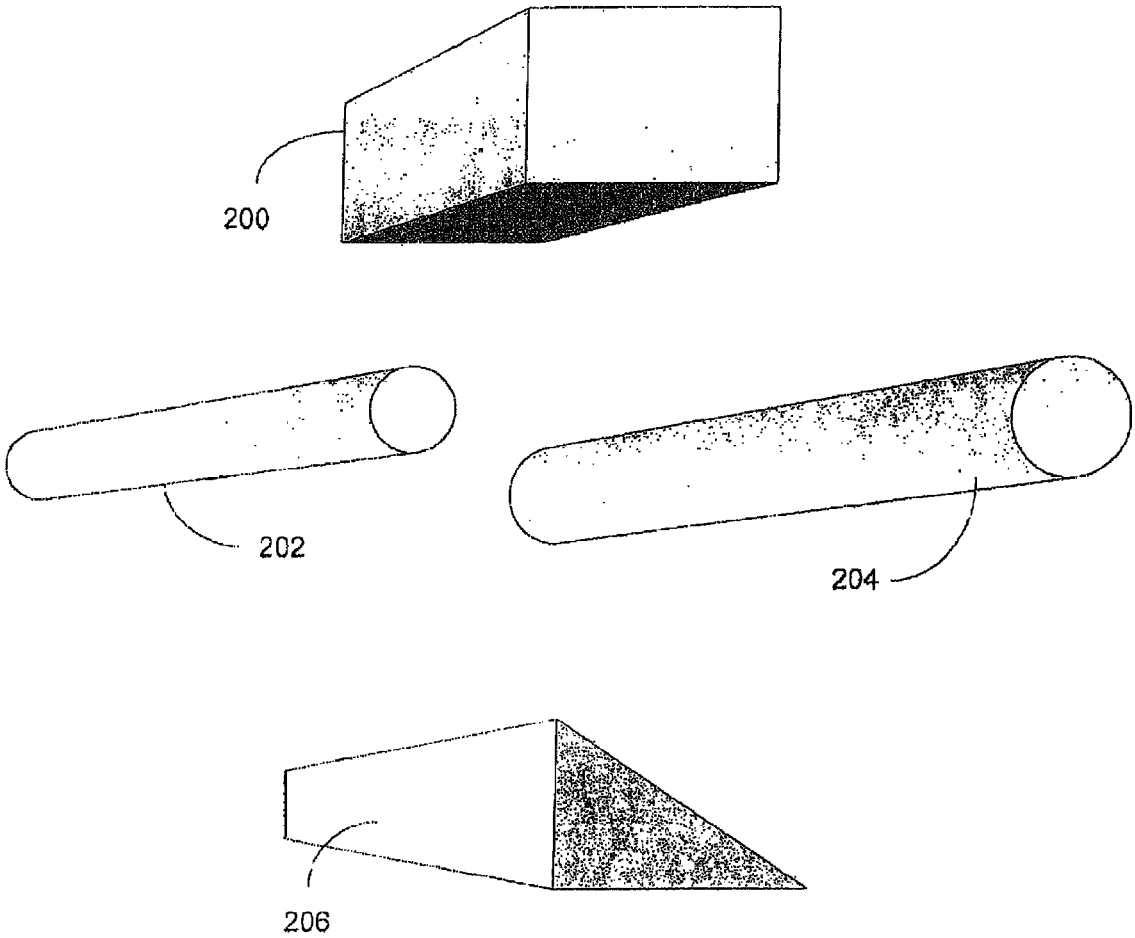
FIG. 10
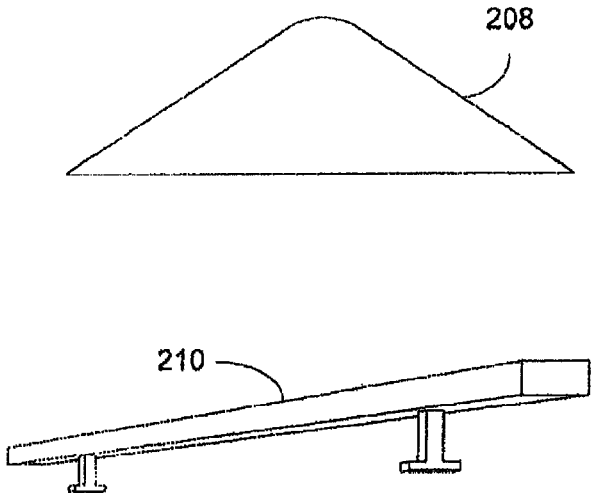

BALANCE BOARD FOR PIPE ROLLER

BACKGROUND

The present invention relates to balance boards, and more particularly a balance board with specially-contoured and textured top and bottom surfaces for being ridden on a pipe roller or other supporting device.

Balance boards are boards that are made to be stood on and balanced on a roller. Balance boards have been in existence for years, although different balance boards may be specifically designed for different purposes. For example, some balance boards are marketed as exercise kits for learning basic balance skills, while others are marketed as sports training devices to improve strength, balance and proprioception. As a sports activity in and of itself, however, conventional balance boards have limited utility by virtue of their design. Further, a large segment of sports activity is known as "extreme" sports (or "action" or "adventure" sports). Extreme sports involves more challenging moves or stunts and a higher degree of difficulty and danger than average sports, and therefore usually requires highly specialized gear. There is presently no known balance board that accommodates the extreme sports market. Most boards are clunky, heavy, and cumbersome to manipulate for extreme board sport use.

Existing balance boards suffer from one or more shortcomings with respect to extreme sports. The first is excessive slippage between the board and the roller. Many existing balance boards are designed with un-textured bottom surfaces and are intended for use with textured, coated rollers. Another shortcoming is that boards are designed either an entirely flat bottom surface, or, from a top view perspective, have an entirely concave lateral plane. Yet other disadvantages include the use of end stops, structures, grooves, and tracks, on the board and/or roller, which hinder a fuller range of motions, specifically pitch motion, yaw movement, and lateral roll of the board. Yet another shortcoming is using rollers of odd shapes, which decrease stability and increase wobble for the rider.

SUMMARY

This document discloses a balance board system comprising a board and a roller, in which the board has angled-up side edges and distal ends for a concave-up shape, but with a planar longitudinal strip on the bottom surface. The balance board system can further include the roller being hollow and of uniform diameter longitudinally. The balance board system can further include a mat or other planar surface that can be rolled up and stored inside the roller for ease of transport and use.

In one aspect, a balance board is presented. The balance board includes an elongated, generally rigid board having a top surface, a bottom surface, and upwardly-angled distal ends and upwardly-angled side edges. The bottom surface of the board has a center plane that extends longitudinally between areas of the bottom surface proximate the upwardly-angled distal ends. The width of the center plane is defined by the upwardly-angled side edges. The bottom surface of the board is at least partially coated with a frictional material.

In another aspect, the balance board is part of a balance board system that further includes a cylindrical roller having a uniform cross-sectional size and shape along its length. In some implementations, the roller is formed of a smooth, rigid material. The roller can include traction cuffs on opposite ends of the roller.

In yet another aspect, the balance board and roller can be provided as part of a balance board kit, to further include a mat that is sized so as to be able to be rolled up and inserted into the roller. A kit can include other devices, such as a box, another roller of equal or different diameter and/or length, a rail, or other device on which the balance board can be ridden.

The details of one or more embodiments are set forth in the accompanying drawings and the description below. Other features and advantages will be apparent from the description and drawings, and from the claims.

BRIEF DESCRIPTION OF THE DRAWINGS

These and other aspects will now be described in detail with reference to the following drawings.

FIGS. 4A-C illustrate operation of a board with a roller according to preferred implementations.

FIGS. 7A-D illustrate other operation of a balance board system.

FIG. 10 shows exemplary devices that can be used in a balance board kit, or used by a rider of a balance board according to implementations described herein.

Like reference symbols in the various drawings indicate like elements.

DETAILED DESCRIPTION

This document describes a balance board system that is suitable for extreme sports, to enable greater freedom of movement of a board relative to a roller or other surface, and allow for more advanced tricks and moves than conventional balance boards.

Figure 3:
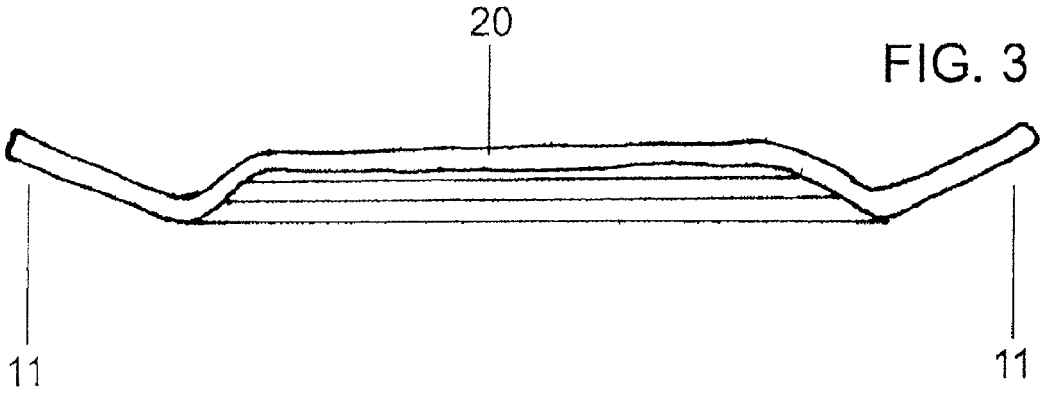
FIG. 3 is a bottom view of the board.
Figure 2:
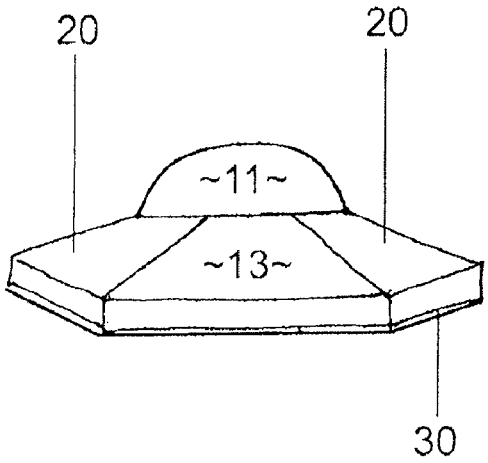
FIG. 2 shows a cross-section of the board.
Figure 1:
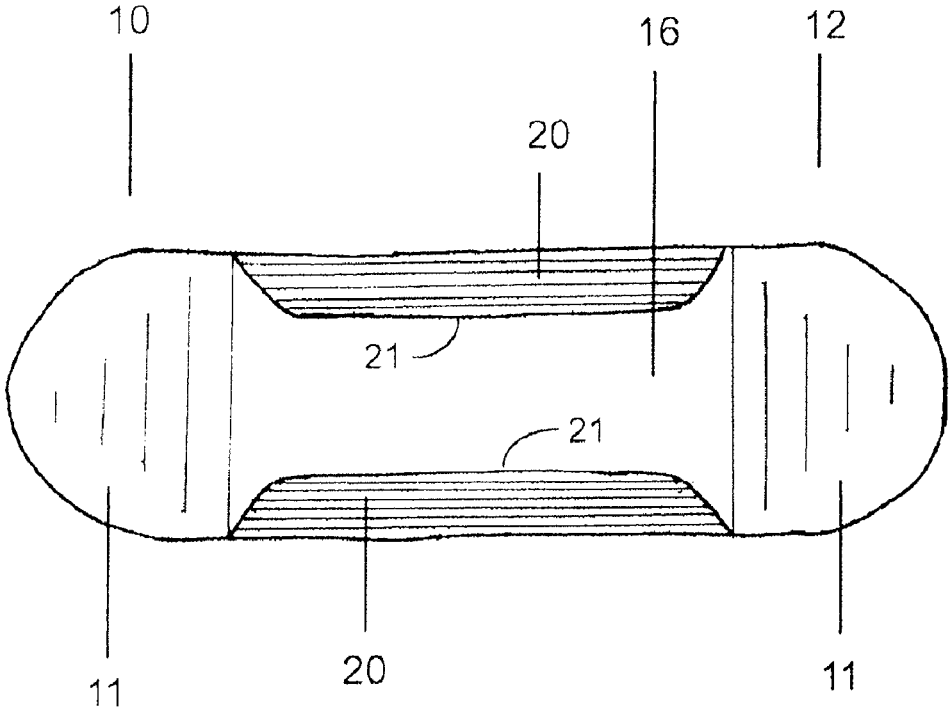
FIG. 1 is a side view of a board in accordance with preferred implementations of a balance board system.

Referring to FIGS. 1-3, a balance board system 100 includes a board 10 and a generally cylindrical, hollow roller (not shown). The board 10 is sized and shaped for being balanced on the roller by a rider, while enabling the rider to perform various moves and tricks on the board and the roller or other device. In exemplary implementations, the board 10 is generally elongated along a longitudinal axis, and generally rectangular or with parallel side edges 20, with distal ends 11 that are preferably rounded and curved upward. The distal ends 11 can be the same size and shape, and angled or curved upward equidistantly, to provide the board 10 with symmetry.

The board 10 further includes a bottom surface 12, a top surface 13 and opposite side edges 20. The bottom surface 12 includes a center plane 16 that extends longitudinally along the bottom surface 12 between regions near distal ends 11, providing a level surface area for the board 10 to ride freely on a roller along either longitudinal or lateral axis, or combination thereof. The center plane 16 of the bottom surface 12 is preferably of uniform width, but can also be hourglass-shaped, or have a larger width in the middle than the ends of the center plane 16.

The center plane 16 is defined on its sides by the opposite side edges 20 that extend upward in a direction toward the top surface 13, also preferably equidistantly, such that the board 10 is concave relative to the top surface 13 and convex relative to the bottom surface 12, and where the bottom surface 12 is angled upward or curved except for the planar middle strip 16. In some implementations, the interface of the opposite side edges 20 and the center plane 16 forms a ridge 21 on either side of the center plane 16 that is distinct and noticeable to the rider. The ridge 21 can be formed by an angle of less than 0.05 degrees to 10 degrees or more. The opposite side edges 20 can be curved or planar, or have a planar region and that terminates in a curved region, or vice versa.

The bottom surface 12 of the board 10 is coated with a frictional material 30 giving the board's bottom surface the necessary friction rating to grip as it rolls atop the roller and resist too much slippage while still allowing turns or rotation between the board 10 and a roller or other surface. The frictional material 30 can include materials such as rubber, elastomer spray, nylon, textured tape, plastisol, stiff paper, synthetic paper, sheet rubber, sheet plastic, or other material or combination thereof, adhered to the board's bottom surface 12. In other implementations, the board can be constructed of a metal-supported rubber structure, or high pressurized textured plastic, carbon, aluminum, etc, with one or more coats of the frictional material 30 applied thereto. Also, many other coats other than the ones listed could be used. In other implementations, the texture of the bottom surface 12 is non-uniform to provide various different levels of grip in certain areas. For instance flat, planar areas can provide greater friction while curved areas can provide less friction. Alternatively, the side edges 20 of the bottom surface 12 can provide greater or less friction than middle strip 16 of the bottom surface 12.

Figure 5A:
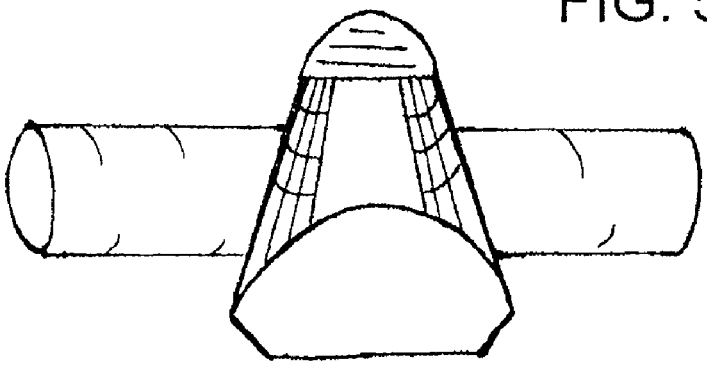
FIGS. 5A-C illustrate further operation of the board.
Figure 5B:
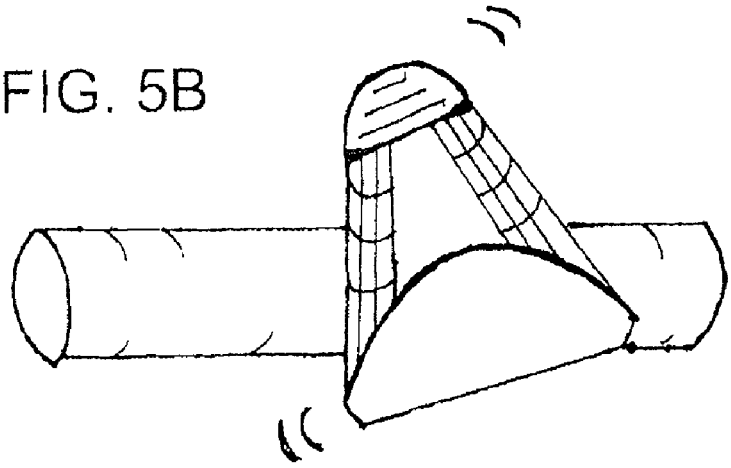
Figure 5C:
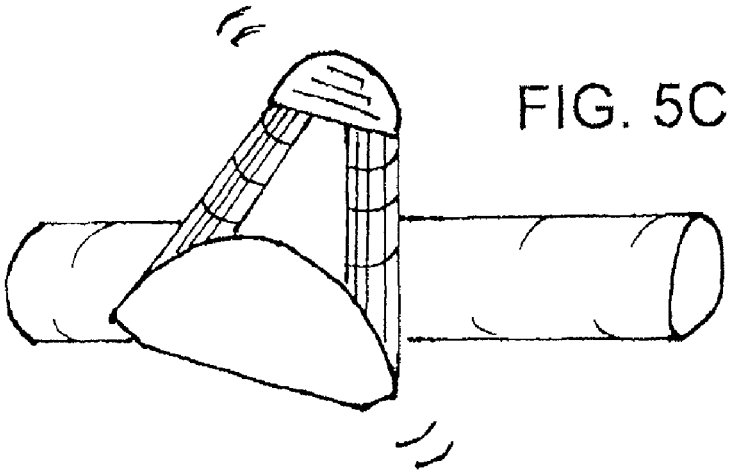
Figure 6A:
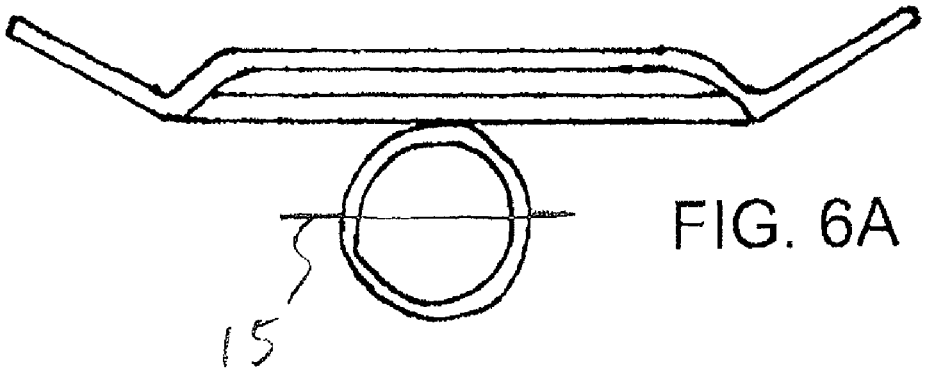
FIGS. 6A-C are side views of a board and roller to illustrate further operation of a balance board system.
Figure 6B:
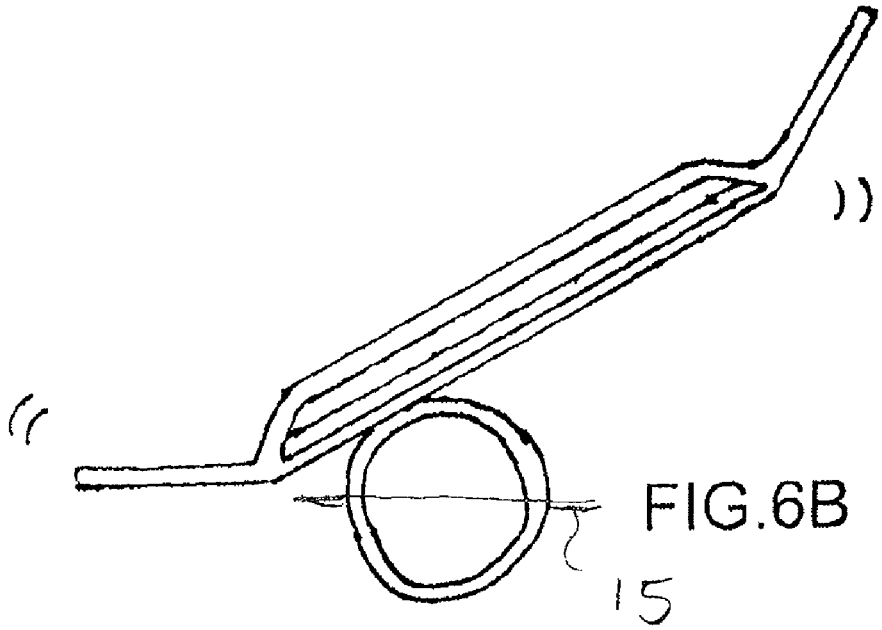
Figure 6C:
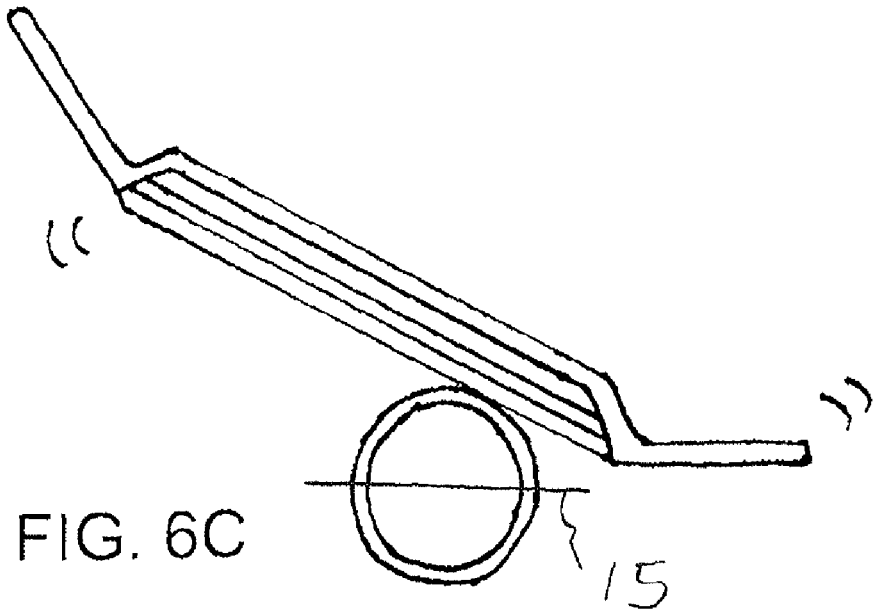

Accordingly, a portion of the top surface 13 over the planar middle strip 16 can also be planar, and the distal ends 11 and side edges 20 provide leverage to a rider for manipulating the board 10 in various kinds of tricks and moves, along the longitudinal and/or lateral axes. Use of the board 10 along its longitudinal axis is illustrated in FIGS. 6A-6C, and use of the board along its lateral axis is illustrated in FIGS. 7A-7D. Rigorous pitch movement along the lateral axis as illustrated in FIGS. 6A-6C requires high surface friction between the board 10 and a surface on which it is ridden. The longitudinal side edges 20 shape the board 10 as concave when viewed from the top, providing flexibility in lateral roll movements of the board 10 along its longitudinal axis, as illustrated in FIGS. 5A-5C.

The top surface 13 can include grip tape or other second frictional material, which may or may not be the same as frictional material 30. The board 10 can be formed of several layers of wood laminated together, or by a unitary composite material such as nylon, plastic, metal or other material.

As illustrated in FIGS. 4A-B, the balance board system 100 further includes an elongated cylindrical roller 40 that preferably has an unchanging cross-sectional diameter. In exemplary implementations, the outside diameter of the roller 40 is four to eight inches and its length is 2.5 to 5.5 feet, although the diameter of the roller can range from 2 inches to more than 12 inches, and the length can range from less than one foot to over six feet. As shown in FIGS. 6A-C and 7A-D, the board 10 can be ridden either along the longitudinal axis 14 of the roller 40, the lateral axis 15 of the roller 40 or yaw at any angle in between. As illustrated in FIGS. 4A-4C, the yaw movement of the board 10 is unimpeded such that the board 10 can be moved 360 degrees relative to the rotational axis of the roller 40. The shape of the board 10 allows it to be flipped or moved by a rider, or rolled longitudinally over a rotating roller 40, or any other move.

The roller 40 is preferably hollow and made of polyvinyl carbonate (PVC), acrylic, vinyl, carbon fiber, bamboo, wood, fiberglass, or other rigid or semi-rigid material. The ends of the roller 40 can be fitted with stops or caps to enclose the interior of the roller 40 for storage of a rolled-up mat or carpet, or other desirable surface on which the board 10 and roller 40 can be ridden when it is unrolled. Each stop or cap can also include an inserted member to provide structural support to an outer region of the roller 40 to maintain the integrity of the roller 40 as it is being ridden.

Figure 8A:
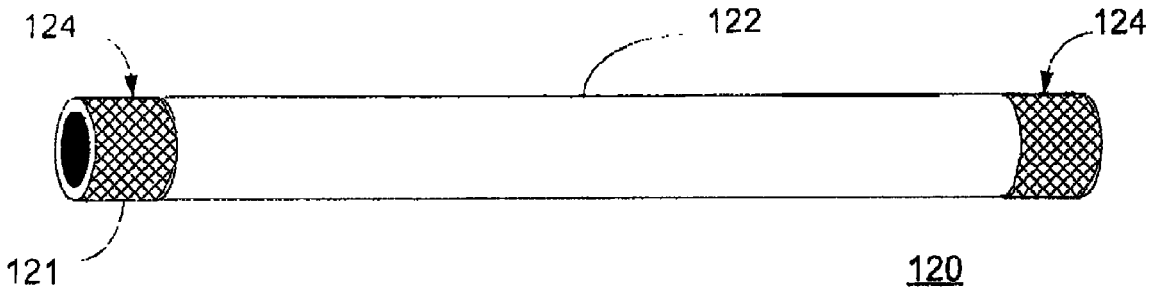
FIGS. 8A-C illustrate various implementations of a roller.
Figure 8B:
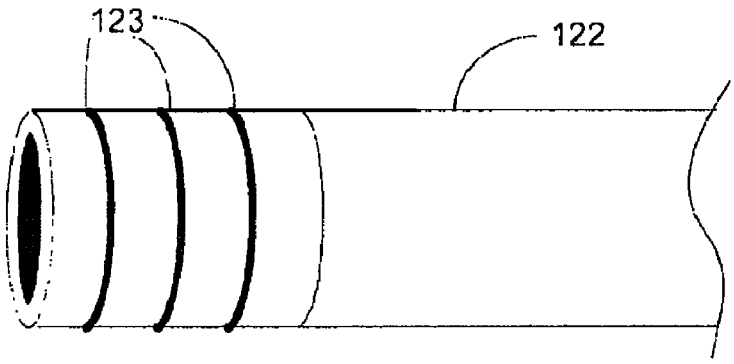
Figure 8C:
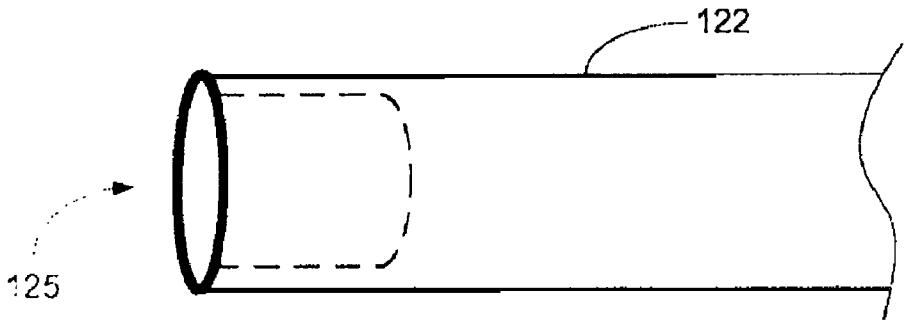

FIGS. 8A-C shows various implementations of rollers. As shown in FIG. 8A, a roller 120 is cylindrical, and includes a riding area 122 along the majority of its length, with traction cuffs 124 on opposite ends of the roller 120. The traction cuffs 124 assist in using the device on hard surfaces such as hardwood floors, concrete, tile, or the like, while still being smooth enough so as to enable movement over a soft surface such as carpet or grass or the like. The traction cuffs 124 can include such materials as rubber, foam or plastic. The traction cuffs 124 can be a band 121 of frictional material that is stretched over the ends of the roller 120, as shown in FIG. 8A. Or, the traction cuffs 120 can be formed of one or more O-rings 123 that are positioned at the ends of the roller 120, such as within an associated one or more grooves that are formed in the outer surface of the ends of the roller 120, as shown in FIG. 8B. Alternatively, the traction cuffs 124 can be attached as separate caps 125 to each of the opposite open ends of the roller 120, as shown in FIG. 8C. The outer portion of each cap 125 can include a traction ring, band or wheel. The traction cuffs can include a smooth surface, treading, or other types of grooves or channels.

Figure 9A:
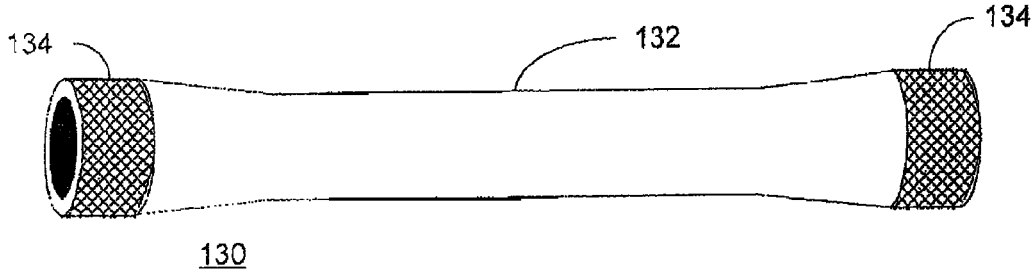
FIGS. 9A-C illustrate further alternatives of a roller.
Figure 9B:
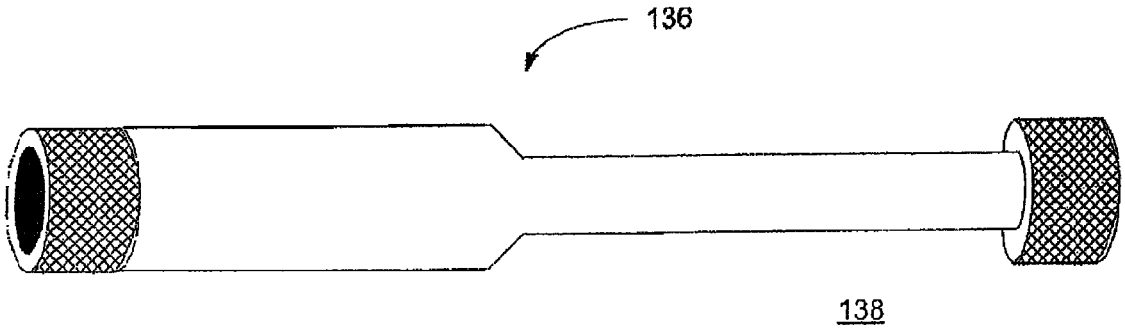
Figure 9C:
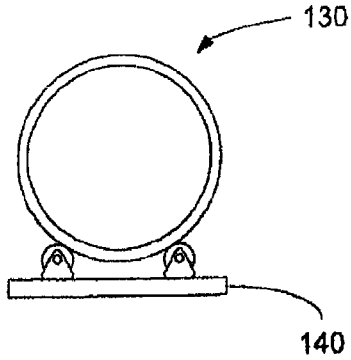

FIGS. 9A-C illustrates several additional alternative implementations of the roller. FIG. 9A shows a roller 130 having a riding area 132 that is a different diameter than traction cuffs 134 positioned on opposite ends of the roller 130. In the implementation shown, the riding area 132 has a smaller diameter than the traction cuffs 134. However, the riding area 132 may have a larger diameter than at least one of the traction cuffs 134. In other implementations, a roller can include one or more tapered ends, or a tapered mid-section, to allow different moves or tricks by a rider. In yet other implementations, a riding area 136 of a roller 138 includes portions of varying diameter. As shown in FIG. 9C, a roller support 140 can be used to support a roller and allow the roller to rotate while inhibiting directional movement.

As illustrated in FIG. 10, the balance board system 100 can include other devices on which the board 10 can be balanced and ridden. These other devices include a box 200, two or more rollers 202, 204 of the same or varying diameter, angled surfaces 206, balance edges and/or point 208, and rail 210.

The board 10 and/or roller 40, can be constructed using any number of manufacturing techniques. For example, the board 10 can be shaped by a molding tool. In this implementation, one or more layers of material such as wood, plastic and/or metal are layered together and then shaped by the molding tool to a desired shape and contour, including the center plane 16. The frictional material or other coating can be sprayed, thermally bonded, glued, adhered, painted, powder coated, spin coated, spin casted, resin casted, injection molded, fusion bonded, sublimated, sputter deposited, vacuum deposited or applied by any other known coating technique. The coating can be uniform for an entire surface of the board 10 or roller 40, or varied as to depth, material, technique, and/or area.

Although a few embodiments have been described in detail above, other modifications are possible. For example, the flat distal ends of the board can be grooved on their bottom surface to allow an expert user to perform certain stalls on the pipe roller. Other shapes besides a generally rectangular shape for the board 10 can also be used. Other embodiments may be within the scope of the following claims.

The invention claimed is:

1. A balance board system comprising:

a cylindrical roller;

an elongated, generally rigid board having a top surface, a bottom surface, and upwardly-angled distal ends and upwardly-angled side edges, the bottom surface of the board having a center plane that extends longitudinally between areas of the bottom surface proximate the upwardly-angled distal ends, the width of the center plane being defined by the upwardly-angled side edges and forming a linear ridge with each of the upwardly-angled side edges, the bottom surface of the board at least partially coated with a frictional material, the upwardly-angled distal ends, upwardly-angled side edges and center plane of the bottom surface of the board enabling freedom of movement of the board relative to the cylindrical roller.

2. The balance board system of claim 1, wherein the frictional material includes rubber.

3. The balance board system of claim 1, further comprising grip tape that at least partially covers the top surface.

4. The balance board system of claim 1, further comprising a cylindrical roller having a uniform cross-sectional size and shape along its length, the roller being formed of a smooth, rigid material.

5. The balance board system of claim 1, wherein the board has a width between 7 and 9 inches.

6. The balance board system of claim 1, wherein the board is formed of two or more layers of wood laminate.

7. A balance board system comprising:

an elongated, generally rigid board having a top surface, a bottom surface, and upwardly-angled distal ends and upwardly-angled side edges, the bottom surface of the board having a center plane that extends longitudinally between areas of the bottom surface proximate the upwardly-angled distal ends and forming a linear ridge with each of the upwardly-angled side edges, the width of the center plane being defined by the upwardly-angled side edges, the bottom surface of the board at least partially coated with a frictional material; and a cylindrical roller having a uniform cross-sectional size and shape along its length, the roller being formed of a smooth, rigid material, the upwardly-angled distal ends, upwardly-angled side edges and center plane of the bottom surface of the board enabling freedom of movement of the board relative to the cylindrical roller.

8. The system of claim 7, wherein the frictional material includes rubber.

9. The system of claim 7, further comprising grip tape that at least partially covers the top surface.

10. The system of claim 7, wherein the roller is formed of PVC.

11. The system of claim 7, wherein the roller includes traction cuffs on opposite ends of the roller.

12. The system of claim 7, wherein the traction cuffs are formed of rubber.

13. A balance board kit comprising:

an elongated, generally rigid board having a top surface, a bottom surface, and upwardly-angled distal ends and upwardly-angled side edges, the bottom surface of the board having a center plane that extends longitudinally between areas of the bottom surface proximate the upwardly-angled distal ends and forming a linear ridge with each of the upwardly-angled side edges, the width of the center plane being defined by the upwardly-angled side edges, the bottom surface of the hoard at least partially coated with a frictional material; and a hollow cylindrical roller having a uniform cross-sectional size and shape along its length, the roller being formed of a smooth, rigid material.

14. The kit of claim 13, wherein the hollow cylindrical roller includes traction cuffs on opposite ends of the roller.

15. The kit of claim 14, wherein the traction cuffs are formed on an outer end of a cap that covers an open end of the hollow cylindrical roller.

* * * * *